United States Patent [19]

Varallo et al.

[11] Patent Number: 4,514,956

[45] Date of Patent: May 7, 1985

[54] VACUUM TRANSFER APPARATUS FOR PACKING LAYERS OF ARTICLES IN A CONTAINER

[75] Inventors: Thomas P. Varallo, Beaumont, Tex.; Albert W. G. Ervine, Bridgeport, Conn.; Joseph J. Duffy, Newark, Del.; Edwin G. Olson, Cabot, Ark.

[73] Assignee: E. I. Du Pont de Nemours and Company, Wilmington, Del.

[21] Appl. No.: 355,230

[22] Filed: Mar. 5, 1982

[51] Int. Cl.[3] ..... B65B 35/56; B65B 19/34

[52] U.S. Cl. ..... 53/148; 53/157; 53/236; 53/238; 53/247; 53/251; 53/543; 53/544

[58] Field of Search ..... 53/499, 157, 537, 538, 53/540, 539, 564, 238, 247, 250, 251, 381 R, 382, 148, 149, 150, 498, 543, 142, 143, 244, 252

[56] References Cited

U.S. PATENT DOCUMENTS

| | | | |
|---|---|---|---|
| 2,173,860 | 9/1939 | Reynolds | 53/537 X |
| 2,819,575 | 1/1958 | Ervine | 53/143 |
| 2,956,384 | 10/1960 | Underwood | 53/537 X |
| 3,123,959 | 3/1964 | Carriere et al. | 53/150 |
| 3,318,068 | 5/1967 | Voullaire | 53/537 |
| 3,323,281 | 6/1967 | Talbot | 53/250 |
| 3,410,050 | 11/1968 | Bell | 53/538 |
| 3,431,698 | 3/1969 | Bathellier | 53/157 |
| 3,434,264 | 3/1969 | Delaney | 53/493 |
| 3,452,653 | 7/1969 | Berney | 493/18 |
| 3,453,802 | 7/1969 | Riddington | 53/494 |
| 3,517,478 | 6/1970 | Winch et al. | 53/142 |
| 3,590,551 | 7/1971 | Riddington et al. | 53/494 |
| 3,609,938 | 10/1971 | Paddock | 53/499 |
| 3,662,516 | 5/1972 | Wiseman | 53/76 |
| 3,856,158 | 12/1974 | Currie | 414/62 |
| 3,859,772 | 1/1975 | Thierion | 53/443 |
| 3,878,665 | 4/1975 | Couten | 53/143 |
| 3,914,921 | 10/1975 | Doran et al. | 53/543 |
| 3,928,942 | 12/1975 | Paddock et al. | 53/247 |
| 3,929,234 | 12/1975 | Warren | 414/737 |
| 3,986,621 | 10/1976 | Bowser | 414/98 |
| 4,329,831 | 5/1982 | Warkentin et al. | 53/537 |

*Primary Examiner*—John Sipos
*Assistant Examiner*—Donald R. Studebaker

[57] ABSTRACT

Packing apparatus for packing layers of cylindrical articles in a container. The apparatus includes means for accumulating a layer of alternately staggered lines of cylindrical articles arranged end-to-end at a pickup position. The apparatus also includes means for making vacuum contact with each article and transferring the entire layer to the container where it is released and forms a tightly packed flat layer. The packing apparatus also includes means for folding back the top flaps of each empty container as it is conveyed to the loading station.

19 Claims, 19 Drawing Figures

46
6B
38
20
36
110
82
52
56
48
60
64
70
58
28
42
50
26
34
38
36
30
46
44
20
38
36
20
36

VACUUM TRANSFER APPARATUS FOR PACKING LAYERS OF ARTICLES IN A CONTAINER

BACKGROUND OF THE INVENTION

1. Field of the Invention

This invention relates generally to loading cylindrical objects into containers, and more specifically, to vacuum transfer for packing in a box successive, separate layers of shotgun shells having a predetermined arrangement.

2. Description of the Prior Art

The present invention may be used whenever high speed, automated packing of objects in separate layers is necessary. It is particularly useful, however, where cylindrical objects such as loaded shotgun shells must be packaged carefully in a predetermined manner for reasons of safety.

Loaded ammunition contains live primers which are percussion sensitive and can be detonated by impact. The primer component is located in the cap or head of the shell, with the primer surface intended to receive impact exposed at the center of the cap. In order to prevent accidental discharge during handling and transportation, it is important that the shells are packed tightly to prevent dislocation and movement within the box. Peripheral liners along the sides of the box have been used to increase box wall integrity and also to ensure a tight fit. Chipboard strips have also been used to separate the rows of shells in a layer, thus maintaining the shells in each row and preventing random dislocations during handling and shipment.

Several prior art devices have been suggested for packing objects by vacuum pickup. For example, U.S. Pat. No. 3,929,234 to W. H. Warren describes a vacuum transfer device which carries eggs from storage cartons where the eggs have one array or spacing to an egg conveyer where they are to have a different spacing. Lifter plates with a plurality of vacuum cups are used for the egg transfer operation, the separation between the vacuum cups being adjustable so that the egg spacing may be modified during transfer.

Similar vacuum suction cups are used in a number of packing systems which pick up and package fruit. Typical of these is U.S. Pat. No. 3,928,942 to Paddock et al which discloses a pickup head equipped with multiple vacuum cups. Panels are used for guiding the pickup head into the box to pack the fruit.

Industrial shotgun shells are typically packed in cardboard boxes with hinged flaps. High speed, automated packing of such boxes requires that they be conveyed empty to the loading station with the top flaps in a position which will not interfere with the packing machinery. Typically, the top flaps are partially open when conveyed to the loading station, but usually must be folded outward just prior to loading in order not to interfere with the packing of the box. If the flaps are not at the proper angle when they arrive at the loading station, jams may occur, thus stopping the packing machinery.

Various prior art devices have been suggested to fold one or more of the flaps or to position the flaps properly for loading. For example, U.S. Pat. No. 3,662,516 granted to J. A. Wiseman describes a means for opening and closing box flaps before and after packing which includes suction cups mounted on levers arranged to pivot about the axis of the flap score line. Also, U.S. Pat. No. 3,452,653 granted to J. C. Berney describes a somewhat more complicated flap folding mechanism which includes flap folding arms mounted pivotally above and parallel to the flap crease line. The aforementioned Paddock et al patent also discloses a flap folding mechanism whereby, as the box is elevated, each of the flaps will encounter a corresponding fixed rod which is inclined upward to lift each flap against a corresponding fixed upper rod.

SUMMARY OF THE INVENTION

The present invention eliminates the need for the chipboard separator strips between the rows of shells in each layer, as well as the need for loose corrugated fiberboard peripheral liners along the sides of the box in order to provide a tight fit for the packed shells. The present invention also provides a means for folding the top flaps properly as an empty box is conveyed to the loading station and returning the flaps to an essentially upright position as the packed box is conveyed away from the loading station.

To accomplish the foregoing goals, the packing apparatus of the present invention employs a novel technique for accumulating a plurality of rows of alternately staggered shells as layers, with alternating head-to-tail orientation of adjacent shells in each row. The resultant layer will then comprise alternately staggered lines of shells arranged end-to-end, with the head-to-tail orientation between adjacent shell lines alternating. The orientation of the shells in the accumulated layer corresponds to the desired orientation of the shells packed in the box. The entire layer of alternately staggered shells is transported by vacuum pickup means and inserted into the box. Upon removal of the vacuum means, the staggered arrangement will, through the force of gravity, become planar as the shells move laterally to fill tightly the lateral width of the box.

Other vacuum means are provided to place dividers between successive layers of shells being packed in the box as well as fiberboard liners at the bottom of the box and, if desired, on top of the last shell layer packed in the box. The sequence of placing liners, dividers and shell layers in the box may be automatically controlled by, for example, microprocessor means.

Empty boxes to be filled are conveyed to the packing apparatus and elevated to the loading station. The top flaps of the boxes are open on all four sides in approximately vertical position. As the box is elevated toward the loading station, the flaps are first guided to an essentially vertical position for engagement with flap folding means. As the box continues to be elevated, the flap folding means causes the flaps to be folded away from the box opening in order to ensure unobstructed entry of the vacuum means carrying the shells, liners and dividers into the box. After the box has been fully loaded, it is lowered and the flaps are returned to their essentially upright position. The loaded boxes with upright flaps are then conveyed away from the packing apparatus for sealing of the flaps and further handling.

While the invention disclosed herein is described generally in connection with shotgun shell ammunition manufacture and packing, it will be readily apparent that the packing apparatus of the present invention can be used wherever high speed automated loading of containers with cylindrical, or even spherical objects is a desired goal.

The nature and novel features which are characteristic of the present invention, as well as other objects and advantages thereof, will become more apparent from consideration of the following description taken in connection with the accompanying drawings, in which:

DESCRIPTION OF A PREFERRED EMBODIMENT

Figure 3:
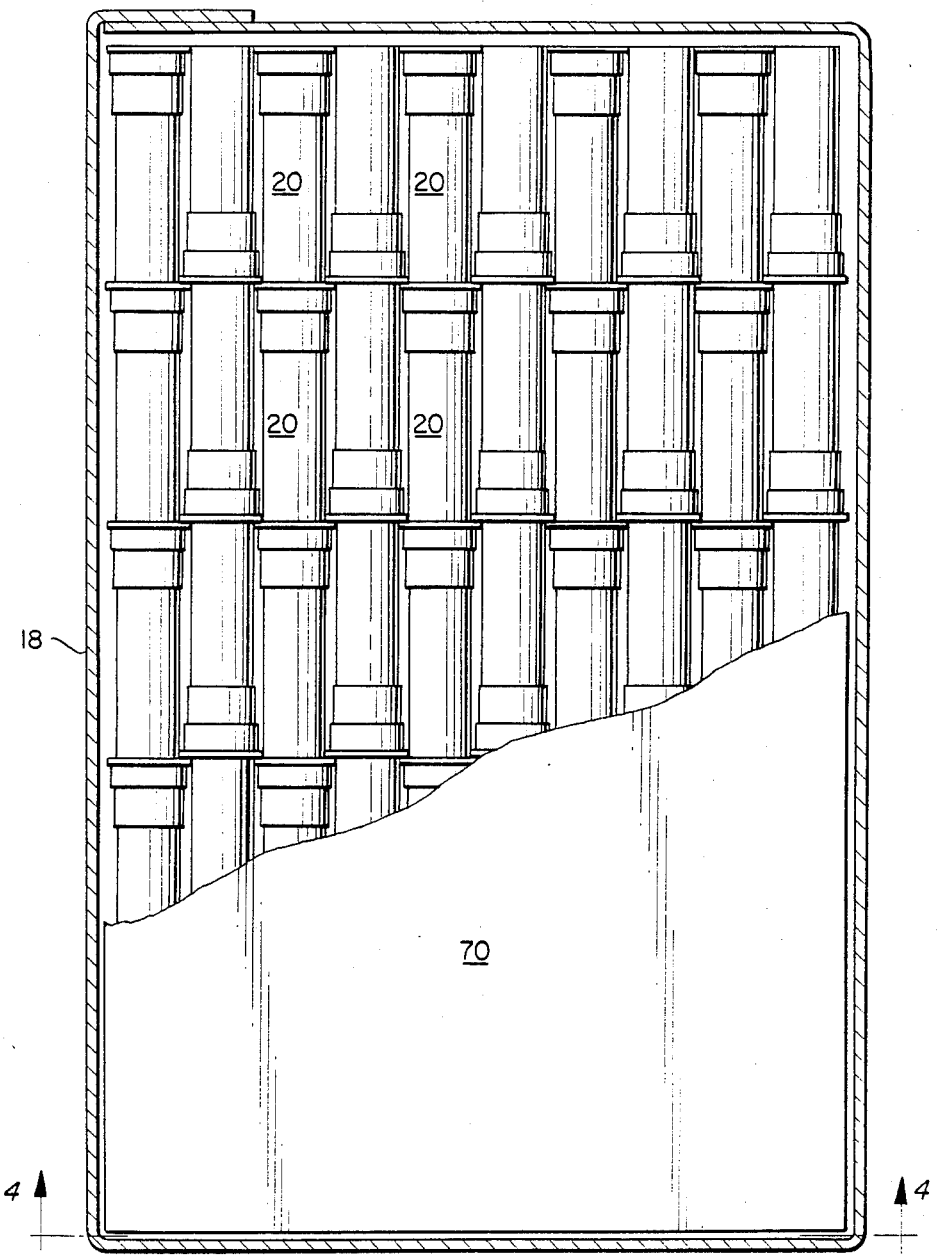
FIG. 3 is a top plan view of a layer of shotgun shells packed in a box by the packing apparatus of the present invention.
Figure 4:
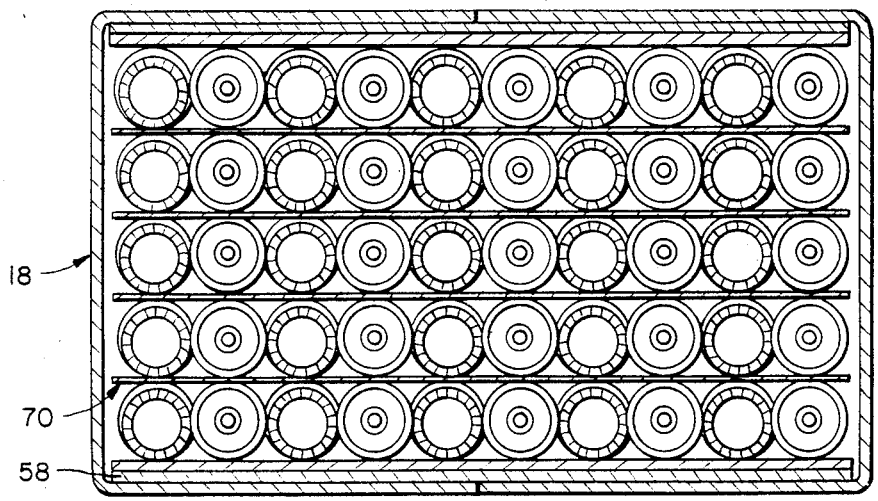
FIG. 4 is a sectional end view of the shells packed in a box taken along line 4—4 of FIG. 3.

FIGS. 3 and 4 illustrate the arrangement of shotgun shells 20 packed in a corrugated fiberboard box 18 by the automatic packing apparatus of the present invention. The box contains 250 shells, five layers of 50 shells each, with five rows of ten shells in each layer. Each layer is separated by a piece of chipboard 70 to prevent shell damage during shipment. There are no separator strips between the rows of shells in each layer; nor are there corrugated fiberboard peripheral liners commonly found in packaged shotgun shell boxes, as well as in boxes of other packaged objects where a tight fit is important. The shells are arranged alternately in each row so that they form lines of alternating head-to-tail orientation in each layer. This shell arrangement reduces the possibility of accidental detonation since the metal caps containing the impact sensitive primer are maintained apart.

Figure 1:
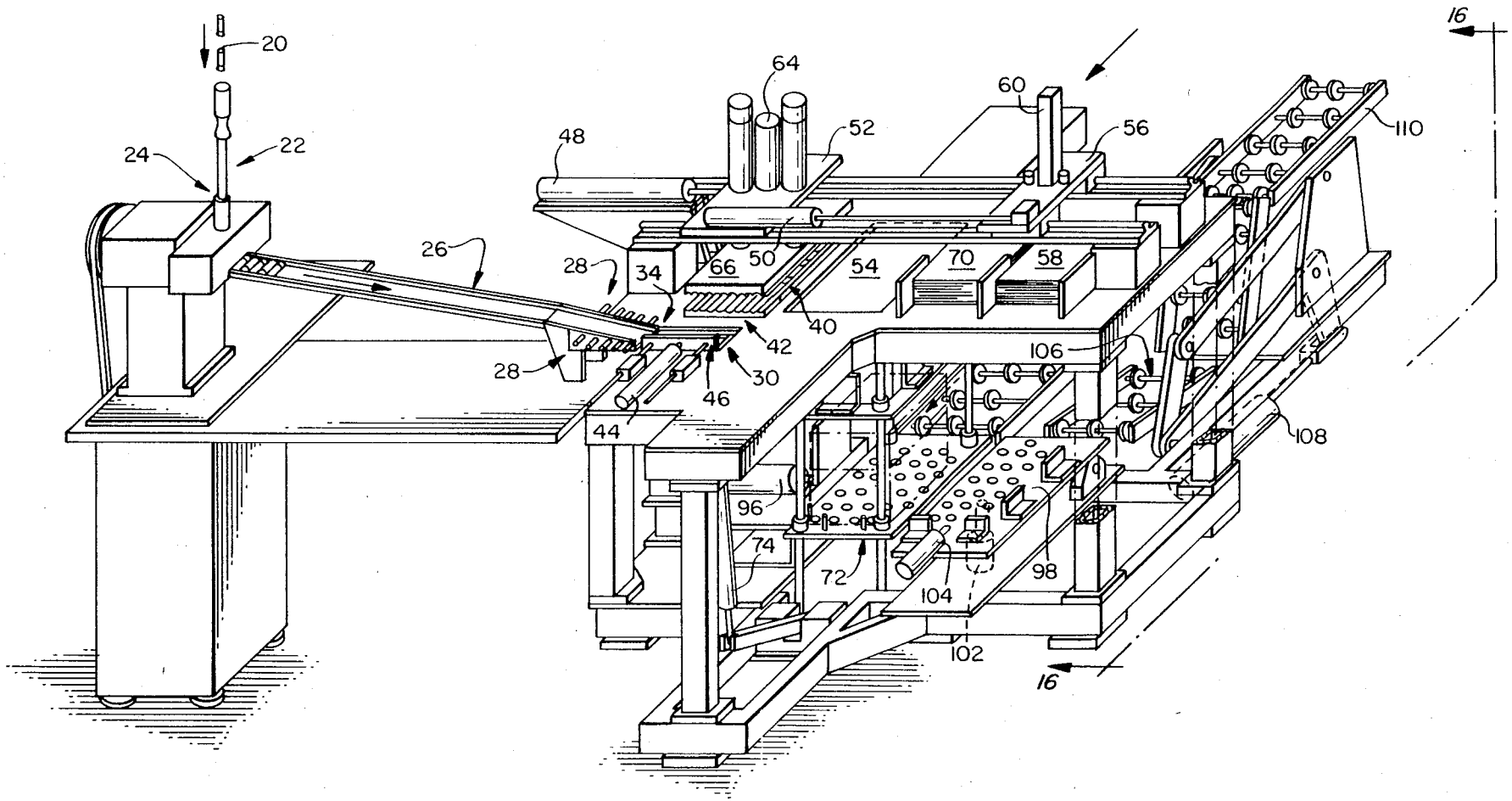
FIG. 1 is a perspective view of a preferred embodiment of the packing apparatus of the present invention.
Figure 2:
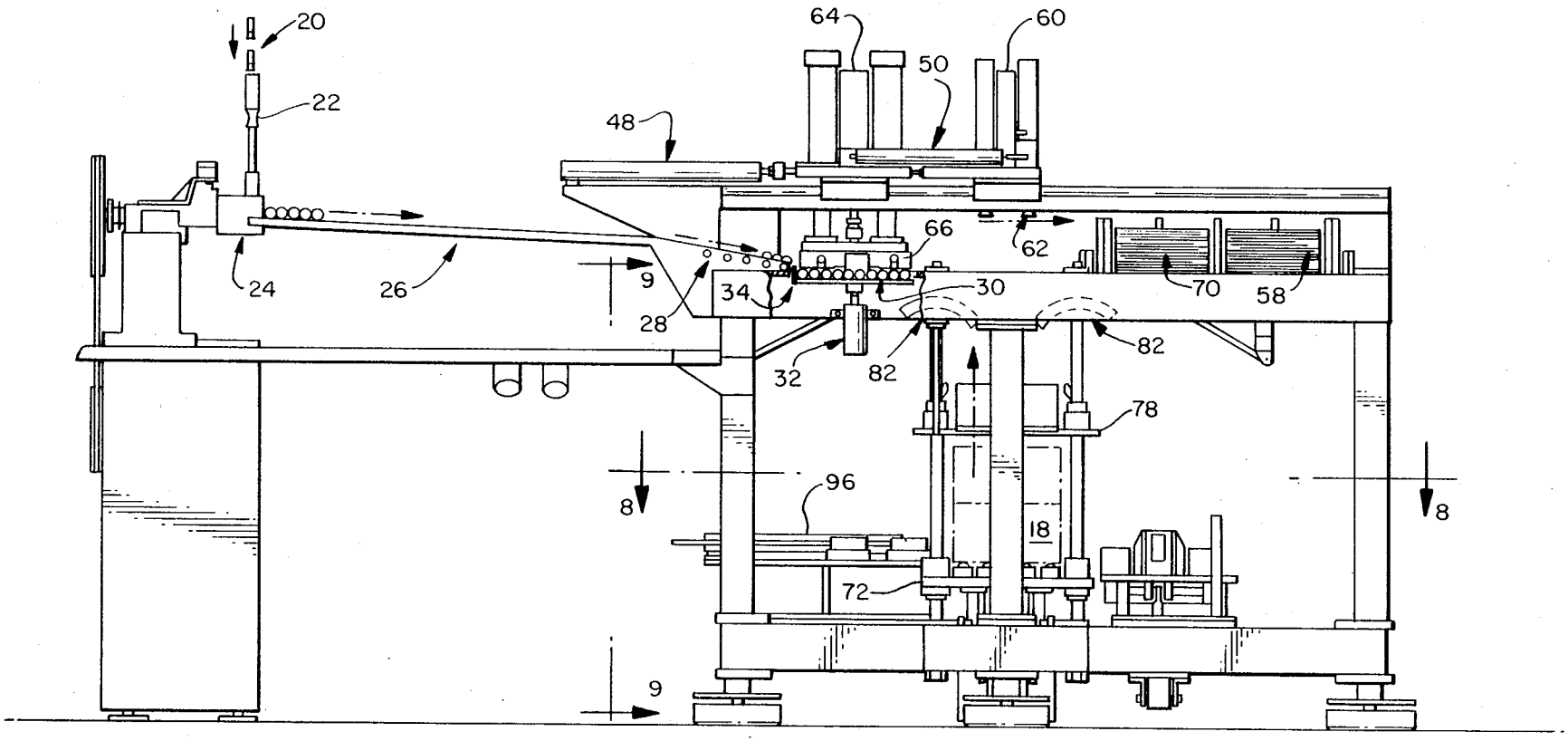
FIG. 2 is a front elevation view of the packing apparatus of FIG. 1.

A preferred embodiment of the automated packing apparatus of the present invention as utilized for packing shells in a box is illustrated in FIGS. 1 and 2. Completed shells 20 are fed down a chute 22 from the last manufacturing station to an alternator device 24. The latter reorients the shells so that they roll down an inspection rail 26 substantially horizontally, alternating head-to-tail.

A gate 34 stops the shells at the bottom of rail 26. Sensing devices such as proximity detectors 28 disposed along both sides of the rail will detect whether the first ten shells blocked by gate 34 have the proper alternating head-to-tail orientation. If the proper orientation is sensed, gate 34 will lower and these ten shells will roll onto a staging tray 30. When a row of ten shells, properly oriented, is on the staging tray, an air cylinder 32 activates to raise gate 34 to prevent additional shells from entering.

Figures 5, 6A, 6B, 6C:
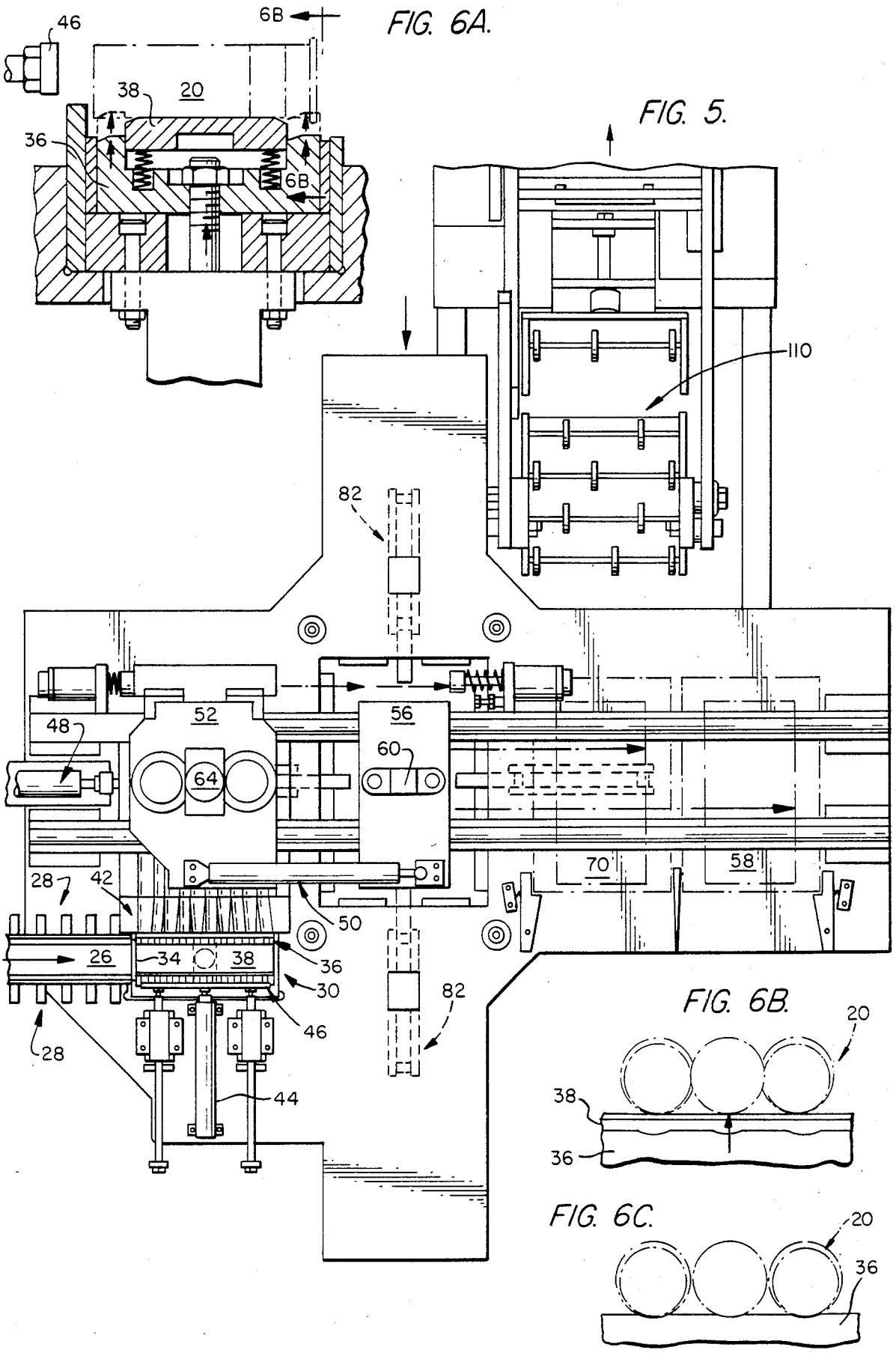
FIG. 5 is a top plan view of the packing apparatus of FIGS. 1 and 2.
FIG. 6A is a partial section view taken along line *6a—6a* of FIG. 6 to illustrate the central and scalloped edge portions of the tray receiving each row of shells.
FIGS. 6B and 6C are schematic views taken along *6b—6b* of FIG. 6A to illustrate the effect of the scallops in the tray edge portions in separating the shells in the row prior to transfer for vacuum pickup.
Figure 6:
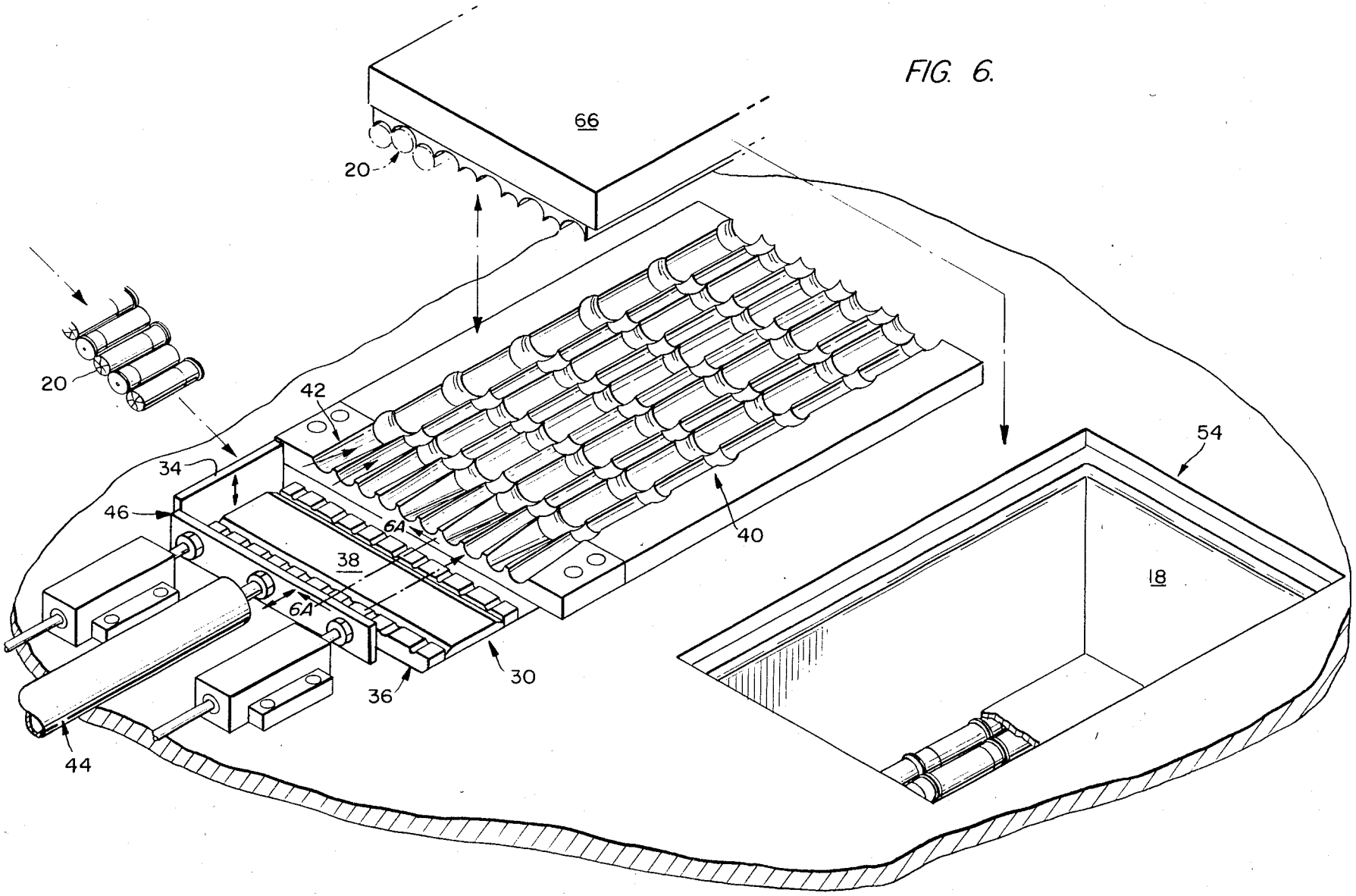
FIG. 6 is a schematic perspective illustration of the means for transferring rows of shells for subsequent vacuum pickup as an alternately staggered layer of shells.

As can be seen with reference also to FIGS. 5 and 6, the staging tray includes a central, stationary portion 38 and scalloped edge portions 36. The latter will rise simultaneously with gate 34 to lift the shells from the central portion 38 of the tray. The purpose of the scallops, as can be seen in FIGS. 6A, 6B and 6C, is to increase the center-to-center separation of the shells, which is necessary for transfer of the shells to an accumulation tray 40 via a transition plate 42 as described below.

The transition plate 42 is shaped so that a flat, side-by-side row of shells will, when pushed across plate 42 in the direction shown by the arrows in FIG. 6, assume an alternately staggered arrangement similar to the profile of the accumulator tray 40. In order to be positioned properly for entry onto the transition plate 42, the shells must be raised and separated slightly from one another. The latter is necessary since the alternating shell orientation results in close spacings between the shells where, for example, the tail or mouth of the shell will rest under the rim of the metal cap. As explained below, the row of shells cannot be transferred readily to the transition plate 42 until this condition is corrected.

As the row of shells is raised by the scalloped edge portions 36, the shell will roll into and rest in the scallops which are spaced to provide the necessary center-to-center separation for proper entry onto the transition plate 42. An air cylinder 44 will then actuate a shell-push bar 46 which will push the row of ten shells from the staging tray 30 onto the transition plate 42.

As discussed previously, the transition plate will transform the row of shells from a flat to an alternately staggered arrangement. This is accomplished because of the unique shape of the transition plate which is profiled at its entry end in a linear array of semi-circles to accommodate a row of shells from the staging tray. From this point, each section of the transition plate 42 is shaped so that the shells will alternately slide down or up until at the exit end of the plate the shells are alternately staggered.

After a row of shells has been pushed onto the transition plate, bar 46 retracts. If detectors 28 have sensed the proper alternating head-to-tail orientation for the next ten shells, gate 34 and scalloped edge portion 36 will be lowered by air cylinder 32 so that a second row of ten shells can enter and roll onto the staging tray 30. The procedure described above is repeated, and the second row of shells pushes the alternately staggered first row onto the accumulation tray 40 as it is pushed onto the transition plate 42 by bar 46. This process is repeated until five rows, or 50 shells, have completely filled accumulation tray 40.

Figure 9:
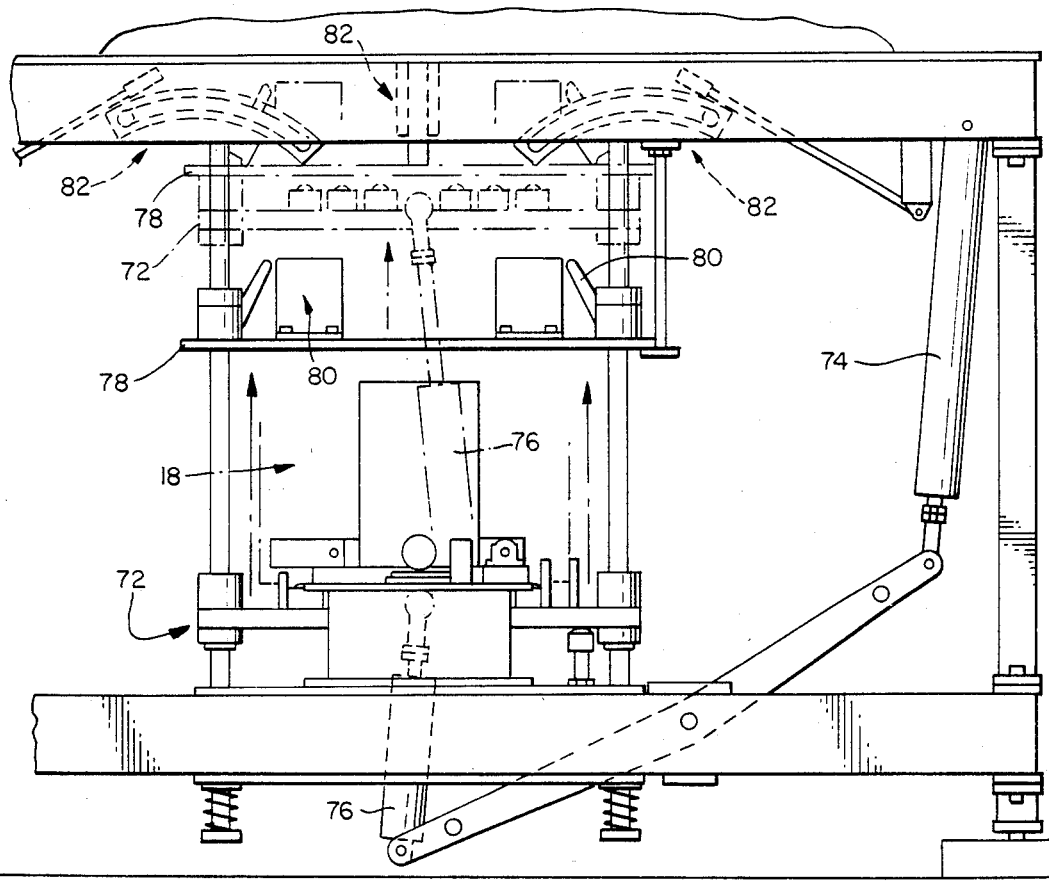
FIG. 9 is a side elevation view of the packing apparatus of FIG. 2 taken along line 9—9 illustrating schematically the movement of the elevator mechanism in raising the box at the loading area.

While the shells are collecting on the accumulation tray 40, air cylinders 48 and 50 are actuated to move a shell shuttle plate 52 to a position above the box loading station 54, and also to move a filler board shuttle plate 56 to a position directly over a stack of corrugated fiberboard 58. As will be explained in further detail below, an empty corrugated fiberboard box 18 is conveyed by appropriate means, such as a belt-driven conveyor, in the direction shown by the arrow in FIGS. 1 or 5, to a position beneath the box loading station 54. The box is then raised upward by an elevator mechanism as shown in FIGS. 2 and 9 to a position where it can accept the shotgun shells.

Referring again to FIGS. 1, 2 and 5, after the filler board shuttle plate 56 is moved by the action of air cylinders 48 and 50 to a position directly above fiberboard stack 58, another air cylinder 60 then lowers filler board vacuum cups 62 connected to the shuttle plate 56 onto the fiberboard stack. Vacuum is valved to the cups 62, and air cylinder 60 retracts with one fiberboard piece 58 held by the vacuum cups 62. Air cylinders 48 and 50 then retract until the shell shuttle plate 52 is returned to its original position above the accumulation tray 40 and the filler board shuttle plate 56 is returned to its original position above the loading station 54. Air cylinder 60 then lowers the board held by the vacuum cups 62 to a position just below the top of the empty box at the loading station. The vacuum is switched off and the corrugated fiberboard floats to the bottom of the empty box.

Figure 7:
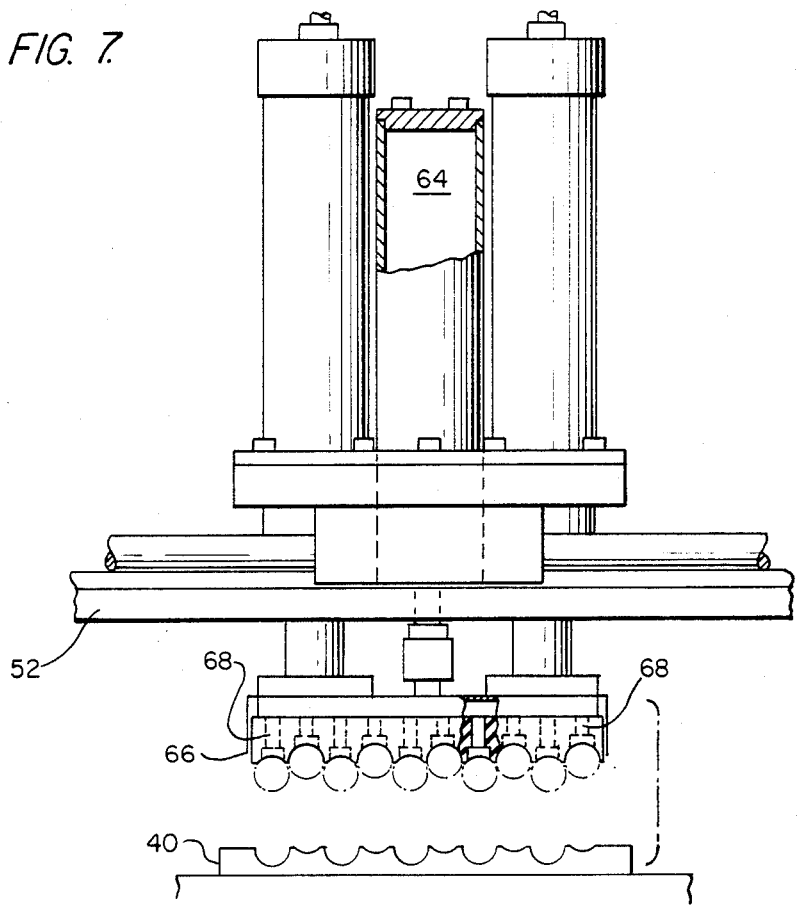
FIG. 7 is a partial schematic end view of the shell vacuum pickup area illustrating the complimentary profiles of a full vacuum platen and an empty accumulation tray.

Another air cylinder 64 lowers a shell vacuum platen 66 disposed under the shell shuttle plate 52 onto the layer of shells which have collected on the accumulation tray 40. Vacuum is switched on to achieve vacuum contact between each shell and platen 66. As air cylinder 64 retracts, the shell platen 66 will lift the entire shell layer as illustrated in FIG. 7. If a shell is missing, the absence of vacuum contact at that shell's position will signal the packing apparatus control that a shell is missing, and will prevent the platen from picking up the layer of shells.

The shell vacuum platen 66 is constructed of flexible material, such as an elastomer, and is shaped so that its profile is similar to that of the accumulation tray 40. The platen is thus able to make vacuum-tight contact with the upper surface of each of the alternately staggered rows of shells in the layer filling the accumulation tray 40. The platen further includes at least one aperture along its point of contact with each shell. Air is evacuated from channels 68 in the platen which extend from each aperture so as to provide points of vacuum contact to each shell. If as mentioned above a shell is missing, its corresponding aperture remains open and the absence of vacuum contact is sensed by the packing apparatus control to stop the packing operation.

When the vacuum cups 62 of the filler board shuttle plate 56 are safely out of the box, air cylinder 48 actuates, extending the shell shuttle plate 52 and its vacuum platen 66 carrying the layer of shells over the loading station 54. The action of air cylinder 48 will simultaneously move the filler board shuttle plate 56 to a position directly over a stack of chipboard separator sheets 70. The shell vacuum platen 66 is then lowered into and toward the bottom of the box 18 by air cylinder 64, the vacuum switched off, and the shells released as a layer on the bottom of the box over the previously inserted fiberboard.

Figures 14, 15:
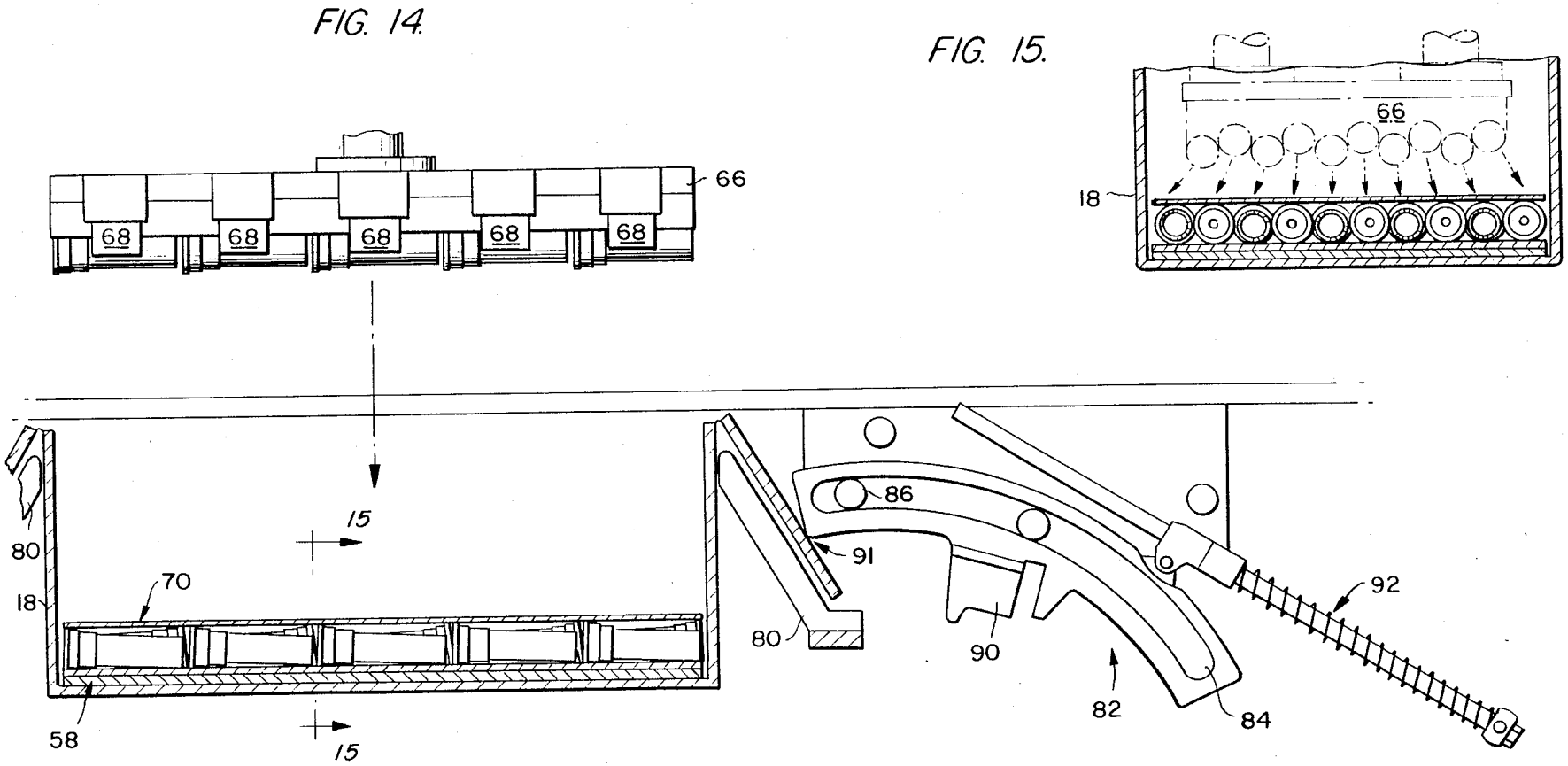
FIG. 14 is a schematic view illustrating the flap in its fully folded back position as layers of shells are lowered into the box by the vacuum platen.
FIG. 15 is a schematic sectional view of FIG. 14 taken along line 15—15 illustrating the spreading effect as a layer of shells is released by the vacuum platen in the box.

FIGS. 14 and 15 illustrate the loading of a shell layer into the box. As the shells are released by the vacuum platen 66, the force of gravity will cause the layer of alternately staggered shells to become essentially planar. In so doing, the shells will move laterally outward and fill the box cross section more completely and tightly.

At the same time the shell vacuum platen 66 is lowered into the box, air cylinder 60 lowers the vacuum cups 62 to pick up a sheet from chipboard separator stack 70 in a manner similar to that described earlier in connection with the corrugated fiberboard stack 58. After shell vacuum platen 66 is retracted from the box by air cylinder 64, and vacuum cups 62 have been raised by air cylinder 60, the shell vacuum platen 66 will be returned to a position above the shell accumulation tray 40 as air cylinder 48 retracts. The filler board shuttle plate 56 is returned simultaneously by the action of air cylinder 48 to a position above the loading station 54. The chipboard sheet 70 held by filler board vacuum cups 62 is then lowered into the box by air cylinder 60. The vacuum is then turned off to release the chipboard sheet over the layer of shells just placed in the box. During this time another layer of 50 shells has collected on the accumulation tray.

In a like manner, shells and chipboard sheets are alternately picked up and placed in the box until it is loaded with five layers of shells. At that time, a second sheet from the corrugated fiberboard stack 58 may optionally be placed on top of the last layer of shells by vacuum cups 62 by actuation of both air cylinders 48 and 50 as described previously.

The movement of an empty box at the loading station and the action of the box flap guides mechanism are best illustrated with reference to FIGS. 2, 9 and 10–14. As described briefly earlier, empty boxes 18 enter the packing apparatus on, for example, a belt conveyor, and they are conveyed to a position below the loading station 54 onto a load station box elevator 72. As soon as an empty box is registered on the elevator 72, air cylinders 74 and 76 actuate simultaneously and raise the box through a box guide frame 78 and past flap guide fingers 80.

The box is originally conveyed to the packing apparatus and onto the box elevator 72 with its top flaps on all four sides in approximately vertical, open position. During the loading procedure, it is important that the flaps be moved out of the way to provide easy, unobstructed access for the shell vacuum plate 66 and filler board vacuum cups 62. This is accomplished through the use of the flap guide and folder mechanism described below.

As the air cylinders 74 and 76 simultaneously raise the box through the box guide frame 78, the box will pass by flap guide fingers 80. In the embodiment shown, two flap guide fingers are located on each side of the box and will urge any flap which may be pointed outwardly into an essentially vertical position, in line with the side of the box. Vertical orientation of the flaps as they are raised by the box elevator is important to prevent jamming of the apparatus and to ensure proper alignment of the top of the flaps for engaging flap folders 82, as explained below. Once the flap fold line 83 is slightly above the top of the flap guide fingers 80, the box guide frame 78 will be engaged by the load station box elevator 72 and continue upward with the elevator, maintaining a constant position relative to the box. The guide fingers 80 will thus remain slightly below fold line 83 even though the box continues upward.

Each of the flaps will engage a flap folder 82 located along each side of the box as the elevator 72 continues to raise the box. This upward movement will cause the flap folders 82 to fold the flaps outward, about the guide fingers 80, until the flaps are folded down along the outer downward sloping surface of the fingers 80 (FIG. 14). At this point, the box is at the loading station, ready for the loading operation described before.

Figure 10:
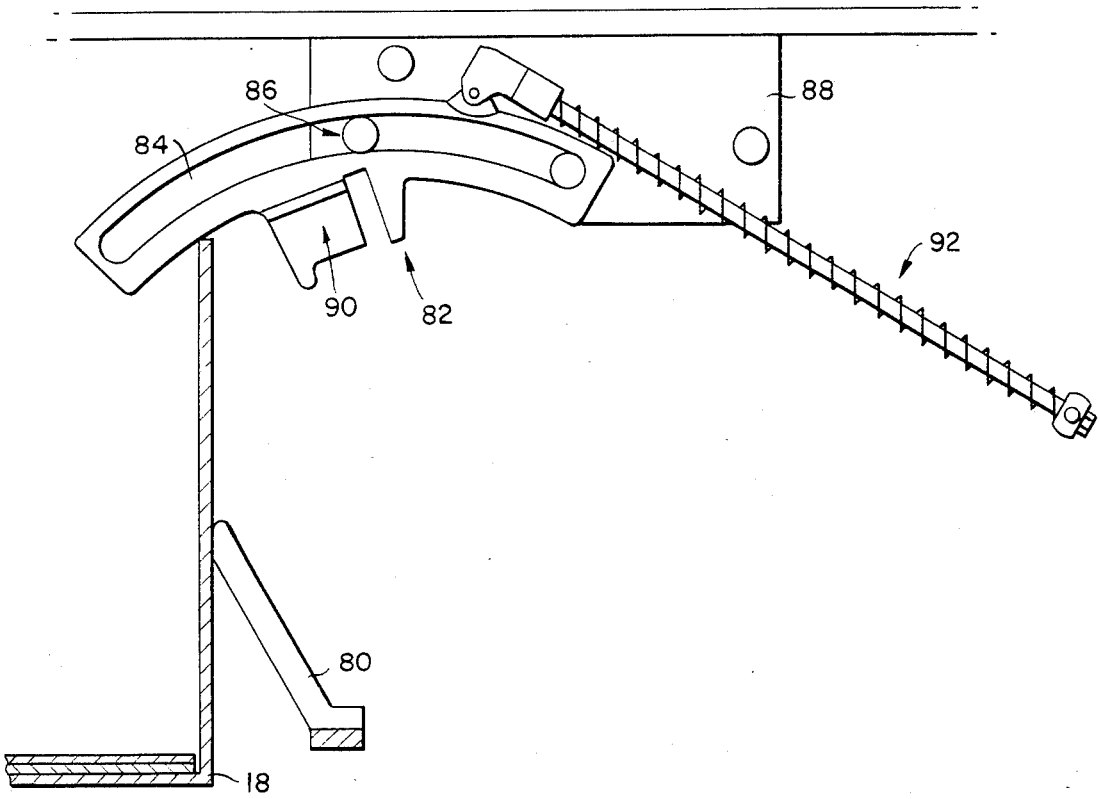
FIGS. 10–13 are schematic views illustrating the effect of the box flap guides and folders in folding the box flaps as the box is raised for loading.
Figure 11:
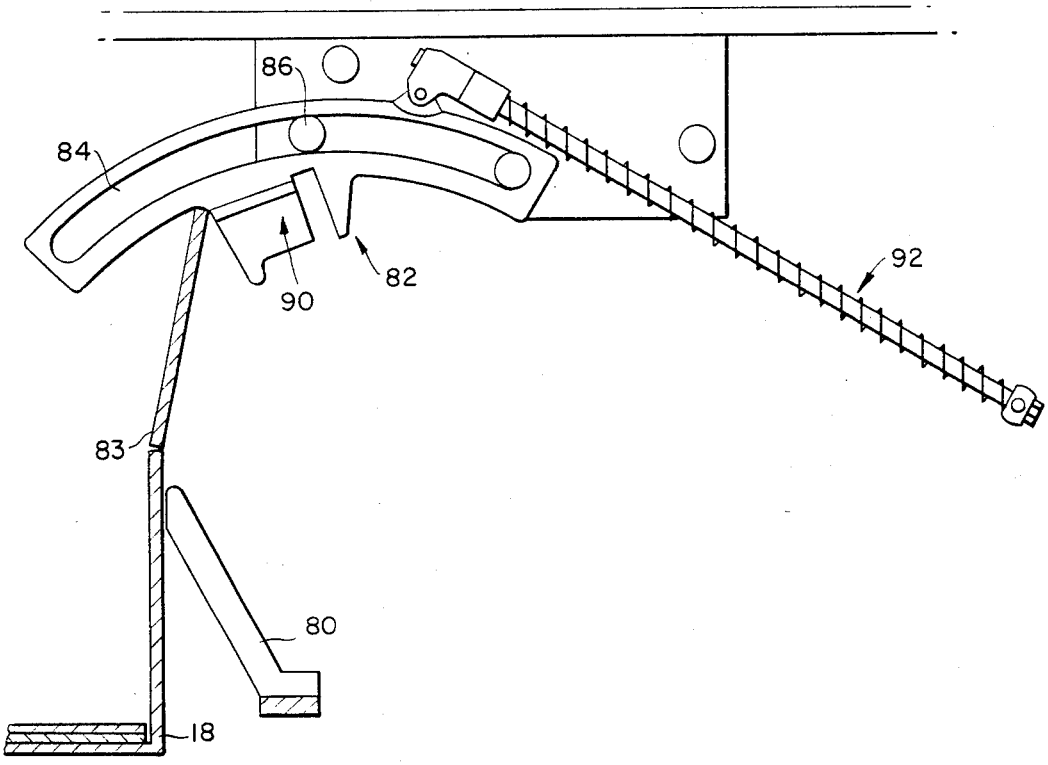

FIGS. 10–14 illustrate sequentially the folding action on one side of the box. Flap folder 82 has an arc-shaped main portion with an arc-shaped central slot 84. The latter provides a cam track for pins 86 from a stationary support 88 secured to the packing apparatus frame, thus enabling the flap folder 82 to move along an arcuate path. When the top of the flap contacts the arc-shaped lower surface of folder 82, it is essentially vertical due to the guide finger 80 (FIG. 10). As the box continues upward, the flap top follows the arcuate path provided by this lower surface, thus bending the flap slightly outward along the fold line 83 (FIG. 11). The flap soon engages a handle-like extension 90 which prevents further movement of the flap along this arcuate path.

Figure 12:
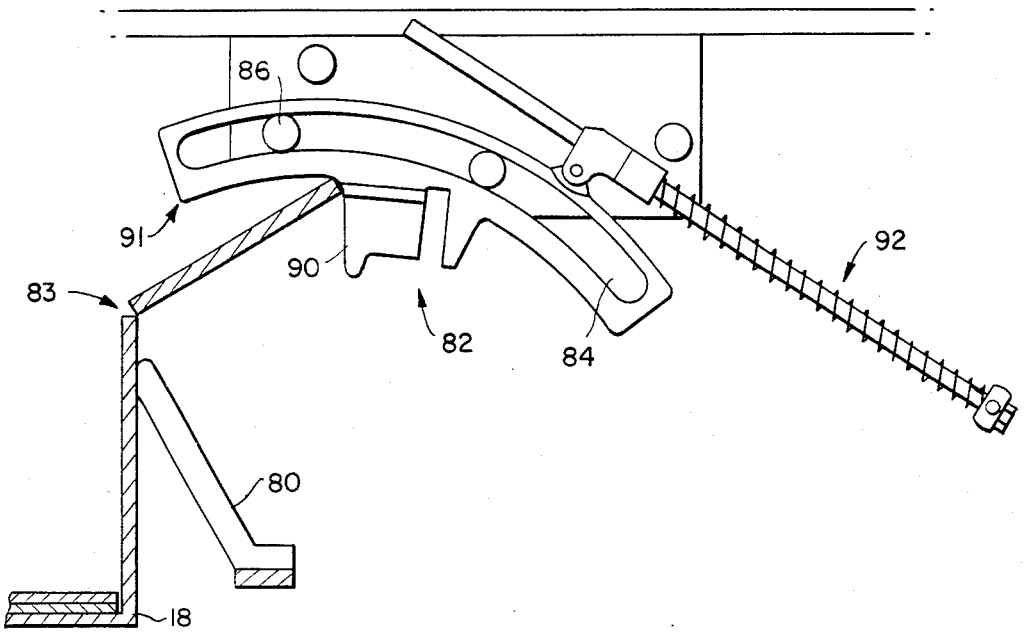
Figure 13:
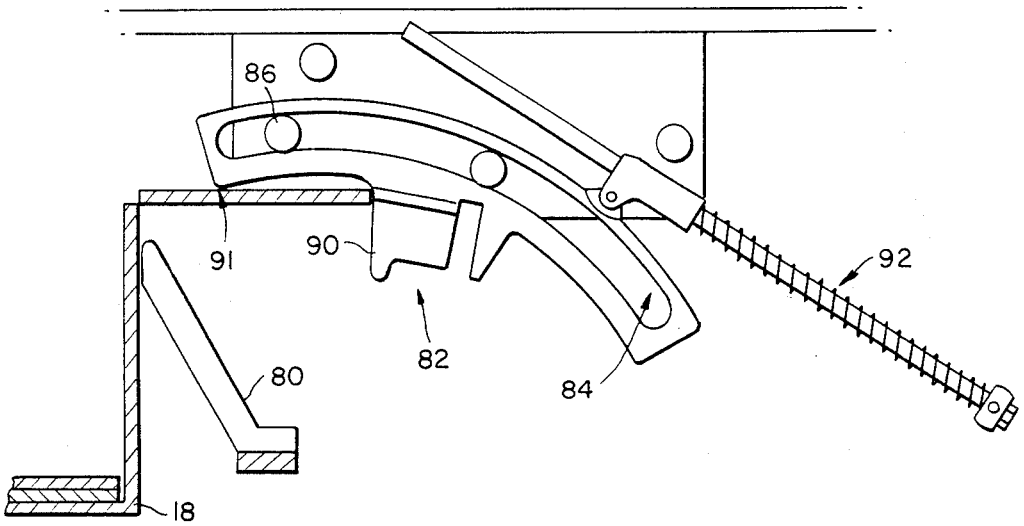

Further upward box movement will then cause the box flap to push the handle-like extension 90 and cause the flap folder 82 to ride back along the pins in arc-shaped slot 84 (FIGS. 12 and 13). This movement is against the spring force exerted by spring biased rod 92 pivotally secured to each flap folder 82. Thus, as the flap pushes against extension 90 until the flap is approximately horizontal (FIG. 13), the folder 82 will be pushed back along slot 84 against spring biased rod 92. At this point, the forward edge 91 of the flap folder 82 contacts the flap and bends it downward toward the flap guide 80. The flap folder continues to be pushed back along slot 84 as its forward edge 91 rides down along the flap, urging the latter into contact with the flap guide 80. Finally, as the box is elevated to the loading station and stops, the flap is folded over and extends downward along the flap guide 80, approximately 60° below the horizontal. The flap is held against the guide finger by the edge 91 of the spring biased folder 82 (FIG. 14).

After the box is loaded, the elevator will lower the box and the above-described flap folding procedure will reverse. The edge 91 of the folder 82 will ride upward along the flap due to the action of the spring biased rod 92 on the flap folder 82. The flap will gradually return to the horizontal position of FIG. 10 and to the almost vertical position of FIG. 11 through the spring-biased action of the flap folder 82. As the box elevator 72 separates from the guide frame 78, the flap will move downward past the flap guides 80, returning the flaps to the approximately vertical position.

Figure 8:
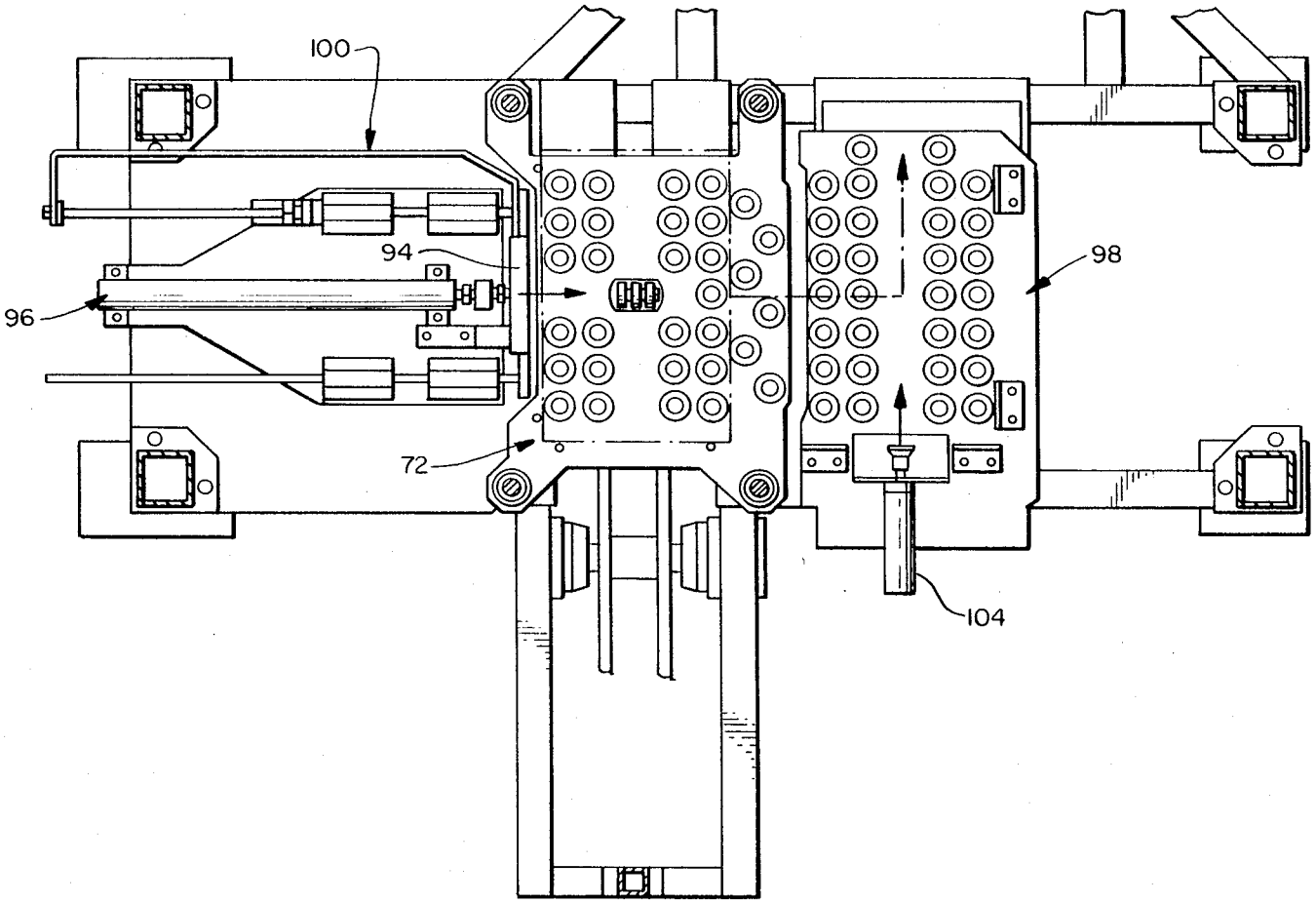
FIG. 8 is a sectional plan view of the packing apparatus of FIG. 2 taken along line 8—8 illustrating the box transfer from the loading area.

When the loaded box has been lowered by elevator 72, it is pushed off the elevator to a box transfer plate 98 by a push bar 94 actuated by air cylinder 96 (FIG. 8). While air cylinder 96 is extended, a box block-out bar 100 keeps other boxes from entering the elevator 72.

Figure 16:
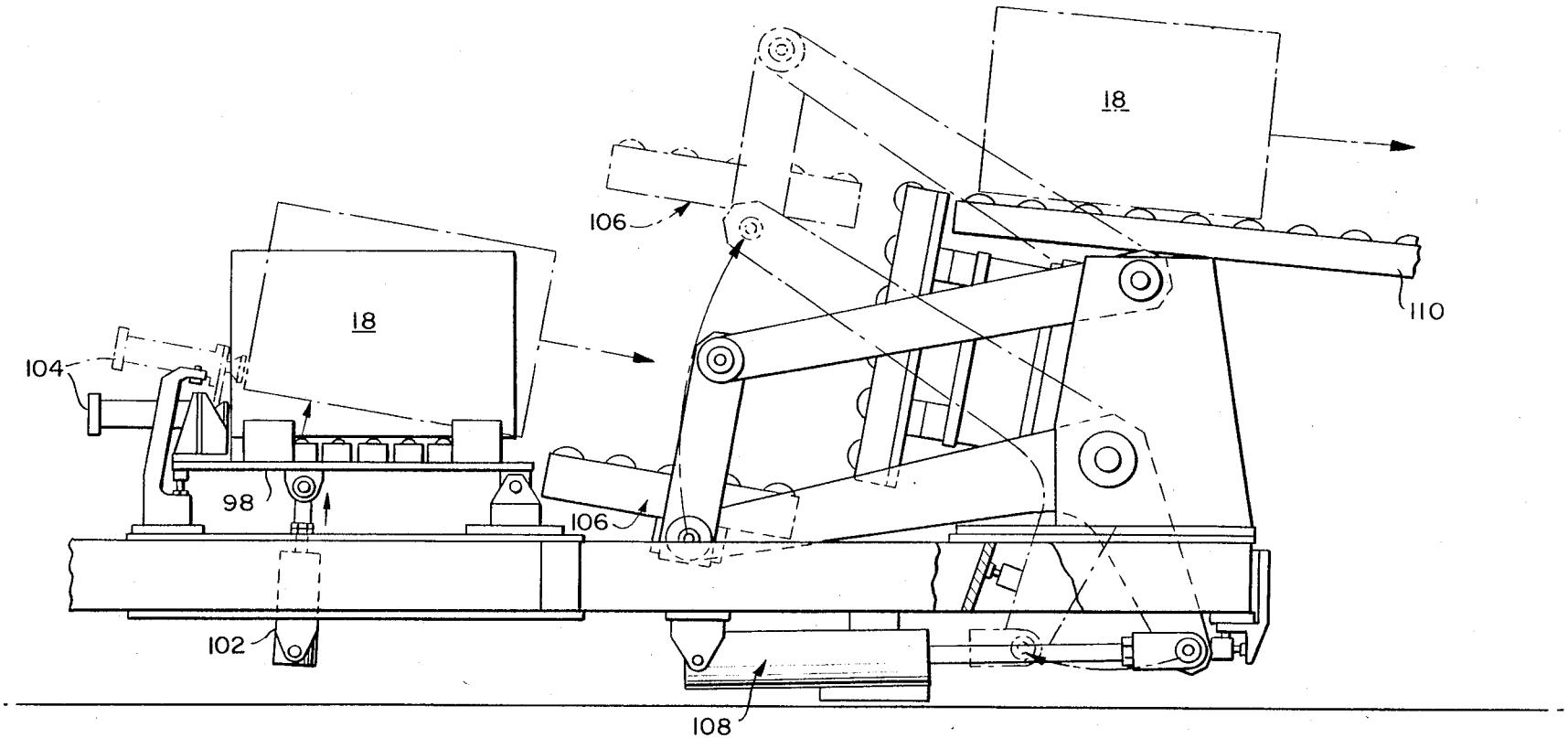
FIG. 16 is a partial side elevation of the packing apparatus of FIG. 1 taken along line 16—16 illustrating the transfer motion of the box discharge elevator.

At this point, as shown schematically in FIG. 16, air cylinder 102 activates to tilt the box transfer plate 98, and another air cylinder 104 extends to kick the box onto a box discharge elevator 106. Another air cylinder 108 actuates to raise the discharge elevator 106 to a position where the box can roll due to gravity onto a standard wheel conveyor 110 at an elevation convenient for handling by the operator. Filled boxes accumulate on the wheel conveyor where an operator periodically staples the boxes closed and removes them onto a pallet for transport to the warehouse.

As is evident from the foregoing description, nearly all operations of the automatic packing apparatus are pneumatically powered. The sequence for activating the various air cylinders and evacuating air for vacuum contact to place fiberboard liners, chipboard separators, and shotgun shell layers in the box, and for moving the box to and from the loading station, is controlled automatically by, for example, a preprogrammed microprocessor control unit.

While the particular embodiments of the invention have been described for purposes of illustration, it will be understood that various changes and modifications can be made therein within the spirit of the invention, and the invention accordingly is not to be taken as limited except by the scope of the appended claims.

We claim:

1. Apparatus for packing layers of cylindrical articles in a container comprising:

feeding means for delivering successive rows of a predetermined number of cylindrical articles oriented horizontally and arranged side-by-side to a staging area;

transition means for alternately vertically staggering the cylindrical articles in each row and for transferring a predetermined number of rows of alternately vertically staggered cylindrical articles to an accumulating area where they will collect as a layer; and vacuum pickup means adapted to make vacuum-tight contact with the side of each cylindrical article in the accumulating area, means for lifting said pickup means so that the entire layer can be lifted in its staggered condition and transferred to a container at a loading station where it is released and forms an unstaggered horizontal and tightly packed layer in the container.

2. The apparatus of claim 1 wherein the feeding means comprises:

a rail down which the cylindrical articles roll;

a gate located at the bottom of the rail blocking the cylindrical articles from entering the staging area; and a staging tray at the staging area adapted to receive the row of side-by-side cylindrical articles when the gate lowers.

3. The apparatus of claim 2 wherein the transition means comprises:

a bar for transferring the row of cylindrical articles from the staging tray after the predetermined number of articles have entered onto the staging tray and the gate raised;

a transition plate disposed lengthwise adjacent to said staging tray and adapted to receive at one side the row as it is transferred from the staging tray; and an accumulation tray disposed at the other side of the transition plate and adapted to receive the row from the plate as another row is transferred onto the plate from the staging tray, whereby a predetermined number of rows will collect on the accumulation tray to form a layer of cylindrical articles.

4. The apparatus of claim 3 wherein the transition plate is shaped so that it can receive at said one side a flat row of cylindrical articles from the staging tray and gradually transform the row as it travels across the plate so that the cylindrical articles will be alternately staggered at the other side of the transition plate.

5. The apparatus of claim 4 wherein the profile of said one side of the transition plate has the shape of a linear array of semi-circles, each representing the entry to a channel transversing the width of the plate, the inclination of the channels alternating so that at the other side of the plate the exits of each channel will be alternately staggered.

6. The apparatus of claim 4 wherein the accumulation tray is shaped to receive and collect a predetermined number of rows of alternately staggered cylindrical articles forming a layer of alternately staggered lines of cylindrical articles arranged end-to-end.

7. The apparatus of claim 6 wherein the vacuum pickup means includes a flexible material having a lower surface contoured so that it is able to provide an air-tight contact with each cylindrical article in the layer on the accumulation tray.

8. The apparatus of claim 7 wherein said lower surface has at least one aperture located at a position corresponding to each cylindrical article in said layer, and said flexible material includes channels leading to said apertures whereby, when air is evacuated from the channels, each cylindrical article will be in vacuum contact with the flexible material at the area of the aperture.

9. The apparatus of claim 3 wherein said staging tray comprises a central stationary portion and side portions adapted to move with the gate, said side portions having a plurality of corresponding recesses so that, when the gate is raised after a row of cylindrical articles has entered onto the staging tray, the side portions will also rise to lift the row from the central portion and cause each article to move until its ends enter corresponding recesses where said article will be in proper position for entry onto the transition plate.

10. The apparatus of claim 7 wherein the lateral width of the layer of cylindrical articles transported by the vacuum pickup is such that, when the layer is released in the container, the alternately staggered cylindrical articles in each row will spread laterally due to the force of gravity and form a flat layer, said lateral spread being sufficient to fill completely the width of the container and to confine tightly the cylindrical articles in the resulting flat layer.

11. The apparatus of claim 2 wherein the cylindrical articles are shotgun shells which have percussion-sensitive primers located at the head of the shell, and further comprising:

alternator means disposed near the top of said rail for alternating the head-to-tail orientation of the shells rolling down the rail;

sensing means disposed near the bottom of said rail for detecting whether the shells at the gate have proper alternating head-to-tail orientation; and control means for receiving a signal from said sensing means and causing said gate to lower to permit a row of shells to enter onto the staging area if the proper orientation has been detected.

12. The apparatus of claim 1 further comprising a second vacuum pickup means for transporting and placing dividers into the container to separate the layers of shells, the sequential lateral and vertical movements of both vacuum pickup means being powered pneumatically and controlled automatically.

13. The apparatus of claim 1 further comprising:

a container feed means for delivering empty containers with open top flaps to the loading station; and a flap folding means for folding the flaps away from the top of the container so as to permit the layer of cylindrical articles carried by the vacuum pickup means to enter the container.

14. The apparatus of claim 13 wherein the container feed means includes an elevator assembly for raising the empty containers to the loading station.

15. The apparatus of claim 14 wherein the flap folding means comprises:

guide members corresponding to each flap and adapted to move with the container after the flaps have been raised past the guide members and urged by said members into approximately vertical position; and fold members corresponding to each flap and adapted to engage the flaps after they have been urged vertically by the guide members and to fold the flaps away from the top of the container as the container is raised.

16. The apparatus of claim 16 wherein the fold members are each adapted to ride along an arc-shaped cam track against a spring force, whereby as the elevator assembly raises the container, each flap will engage a corresponding fold member and urge said fold member to move along the cam track, the resulting arc movement of the fold members folding the flaps out and down toward said guide members.

17. The apparatus of claim 15 wherein the guide members and fold members are adapted to act cooperatively to cause the flaps to return to the approximately vertical position after the container is loaded and lowered by the elevator assembly.

18. The apparatus of claim 14 further comprising container discharge means, and wherein the elevator assembly and said container discharge means are powered pneumatically.

19. The apparatus of claim 3 wherein the vacuum pickup means, the gate, and the bar are powered pneumatically.

* * * * *